US010773413B2

(12) United States Patent
Szymanski

(10) Patent No.: US 10,773,413 B2
(45) Date of Patent: Sep. 15, 2020

(54) SAW CHAIN AND SAFELY CONNECTED LINKS THEREFOR

(71) Applicant: David A. Szymanski, St. Mary's, PA (US)

(72) Inventor: David A. Szymanski, St. Mary's, PA (US)

( * ) Notice: Subject to any disclaimer, the term of this patent is extended or adjusted under 35 U.S.C. 154(b) by 610 days.

(21) Appl. No.: 14/941,054

(22) Filed: Nov. 13, 2015

(65) Prior Publication Data

US 2016/0136837 A1 May 19, 2016

Related U.S. Application Data

(60) Provisional application No. 62/079,696, filed on Nov. 14, 2014.

(51) Int. Cl.
*B27B 33/14* (2006.01)
*B27B 17/00* (2006.01)

(52) U.S. Cl.
CPC ..... *B27B 33/14* (2013.01); *B27B 17/00* (2013.01)

(58) Field of Classification Search
CPC ..... B27B 17/00; B27B 33/14; B27B 25/00
See application file for complete search history.

(56) References Cited

U.S. PATENT DOCUMENTS 5,729,882 A * 3/1998 Travis ..... B21J 15/02 29/444
2007/0125219 A1* 6/2007 Seigneur ..... B27B 33/14 83/835
2008/0034938 A1* 2/2008 Fuchs ..... B27B 33/14 83/830
2008/0110317 A1* 5/2008 Osborne ..... B27B 33/14 83/830
2011/0120280 A1* 5/2011 Szymanski ..... B23D 61/06 83/13

* cited by examiner

*Primary Examiner* — Stephen Choi
(74) *Attorney, Agent, or Firm* — Fay Sharpe LLP

(57) ABSTRACT

A saw chain includes a tie strap adapted to be pivotally connected to other links of the saw chain. The tie strap features an interior hole with a chamfered edge. An interior counterbore in the interior hole receives a barrel portion of a rivet. The rivet has two flanges extending from both sides of the barrel, each with a smaller diameter than the barrel, and each with chamfered corners in a transition area where the flanges meet the barrel. An exterior counterbore on an exterior surface of the tie strap receives a rivet head formed from one of the flanges, such that an exterior surface of the rivet head sits flush with the exterior surface of the tie strap.

13 Claims, 5 Drawing Sheets

SAW CHAIN AND SAFELY CONNECTED LINKS THEREFOR

BACKGROUND

A variety of devices exist for cutting or abrading materials including masonry, concrete, metal, glass, wood and stone. These devices employ various implements for cutting or abrading including chain and rotary blades.

In the timber industry, wood is cut, for example, using chain saws and timber harvesters. The particular chain that is used depends on the area and condition of the wood being cut. The component links of all saw chains undergo expected wear. For example, teeth of saw chains become dull which is typically addressed by the time-consuming process of sharpening the teeth or changing-out the dull chain with a sharpened chain. Forces from normal chain operation weaken the component links, leading to the risk of chain breakage or chain shot.

Chain shot refers to what happens when a piece or pieces of a cutting chain separate from the end of a broken saw chain at a high-velocity. After a chain break, the free end of the chain begins to whip away from the break. Unless contained, the broken chain's free end is allowed to rapidly accelerate. At the peak of the whip the chain is carrying extreme kinetic forces, which can cause a chain piece or pieces to separate and be ejected in a ballistic nature, creating a serious risk of injury or death to operators and bystanders.

Various attempts have been made to reduce the problem of chain shot. The proposed solutions have included heat treating rivets to varying hardness levels to achieve greater shear resistance. The subject disclosure provides an alternative approach to avoiding chain shot breakage at the rivet.

BRIEF DESCRIPTION

According to a first embodiment, a saw chain comprised of at least one chain link selected from a cutting link and a drive link and at least one tie strap pair is provided. The chain link and the tie strap pair define a hole passing therethrough. A rivet is disposed within the hole and joins the cutting link and the tie strap pair. The rivet comprises a central barrel region and two opposed flanges. The barrel region is received within a center bore of the hole. Each of the flanges passes through a reduced diameter region of the hole formed by projections from each of the tie strap pair such that internal edges of the projections cooperatively retain the barrel region. Each flange terminates in a head region engaging an external surface of the projections.

In accordance with a further aspect of the present exemplary embodiment, a saw chain is provided with a tie strap whose thickness is not limited in the manner of existing designs. Tie straps known in the art generally have a width or thickness approximately equal to the gauge of the drive link. Tie straps necessarily connect to the outside of the drive links, such that a contact area between the tie straps and guide bar rails in existing systems creates a bearing surface that only partially covers the edges of the guide bar rails. The tie straps disclosed herein have an increased thickness, allowing for the contact area or bearing surface to be approximately doubled. Accordingly, the edges of the guide bar rails are completely covered, greatly reducing bar wear.

The tie straps disclosed herein also allow for an exterior counterbore to be formed on the outside surface of the tie strap. The exterior counterbore allows a rivet head of a connecting rivet to sit flush with the tie strap exterior surface. The rivet features chamfered corners in a transition area between a larger diameter middle barrel and smaller diameter flanges, which extend from either side of the barrel. The tie strap hole features a chamfered edge which complements the chamfered corners of the rivet when the tie strap receives the rivet for connecting. The tie strap hole also features an interior counterbore for receiving the barrel portion of the rivet, which has a longer length compared to known rivet designs.

Other embodiments of the disclosure are contemplated to provide particular features and structural variants of the basic elements. The specific embodiments referred to as well as possible variations and the various features and advantages of the disclosure will become better understood from the accompanying drawings in conjunction with the following detailed description.

DETAILED DESCRIPTION

Figure 1:
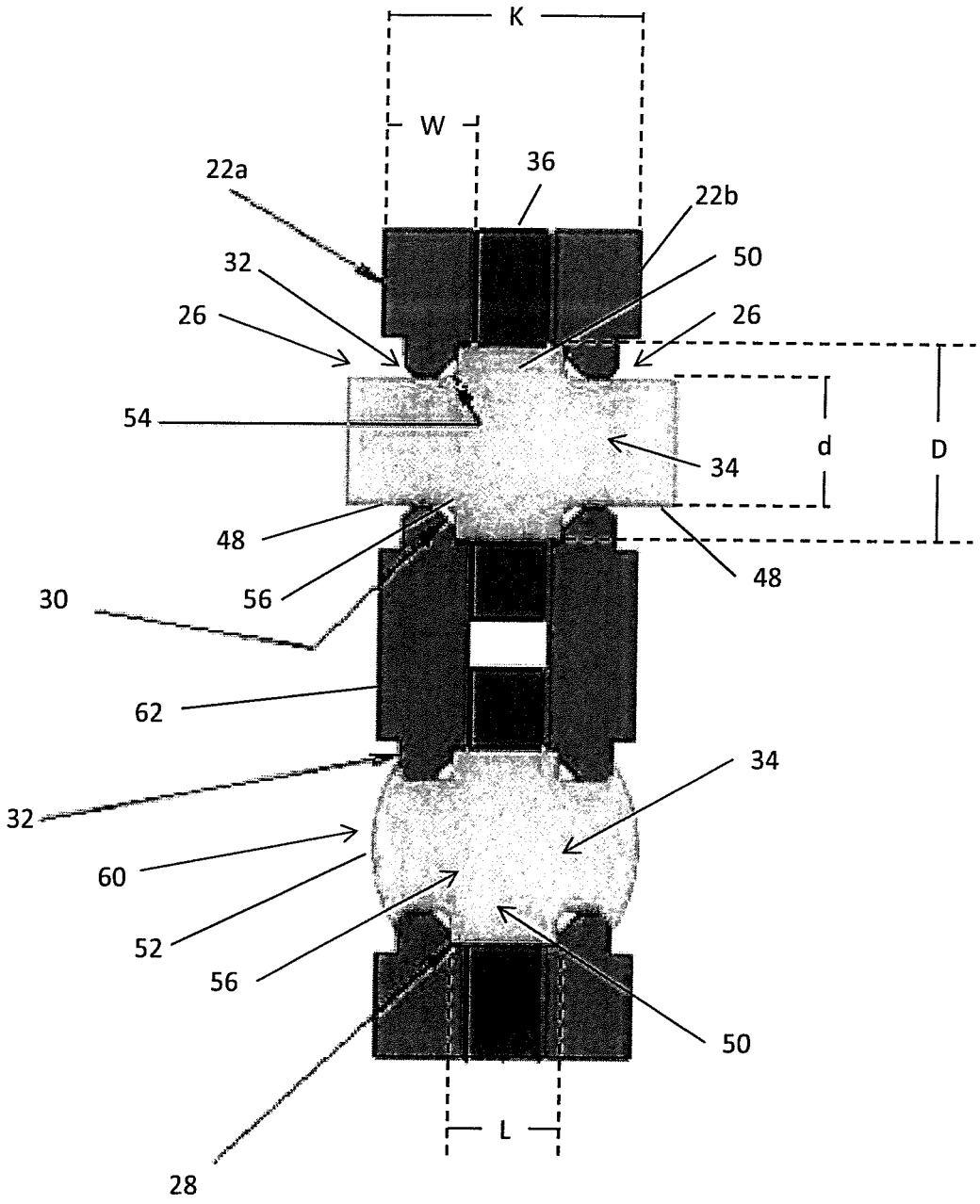
FIG. 1 is a top view cutaway of a portion of a saw chain showing a tie strap and rivet design in accordance with the present disclosure.

With reference to FIGS. 1-8, the saw chain portion 10 includes a plurality of links 12 including holes 14 for receiving a connecting rivet 16. Cutting links 18 each comprise a holder or holding link 20 pivotally connected at each end to a connecting link or tie strap 22. A plurality of cutters or teeth 24 are each adapted to be removably retained on one of the plurality of holding links 20. The combination of holding link 20 with replaceable tooth 24 functions as a conventional one-piece cutting link 18. Although the present invention includes the concept of replaceable teeth on a holding link, it is also intended to encompass more traditional cutting link designs wherein the teeth are integrally formed with the remainder of the link.

Tie straps 22 are located between the cutting links 18 and pivotally connect the cutting links to other links 12 in the chain 10. With specific reference to FIG. 1, the holes 26 of the tie straps 22 comprise an interior counterbore 28, a radiused or chamfered edge 30, and an exterior counterbore 32 for receiving a rivet head 52.

The interior counter bore may act as an oil reservoir where there is clearance between the rivet barrel and the inside of the counter bore. Capillary action will allow oil to wick into this area and to be released directly onto the area of the rivet barrel that is inside of the drive link as the chain warms during use.

Other links in the chain of this particular design are contemplated in the disclosure. For example, with specific reference to FIG. 2, drive links or drivers 36 engage the chain saw sprocket and optional sprocket at the end of the saw chain guide bar in a conventional manner (not shown). Drive links 36 include surfaces 38 for engaging a sprocket of the saw. Drive links 36 are pivotally connected to the cutting links 18 or other links 12 in the chain by the tie straps 22. As another example, safety links 40, each being located in front of one of the holding links 20, are optionally provided. Safety links 40, similar to drive links 36, include surfaces 42 for engaging a sprocket of the saw. Some links of the chain include rakers or depth gauges 44, which set the depth of the teeth (i.e., the thickness of the wood chip that is cut). The depth gauge rides on the wood and the tooth edge follows behind. The tooth cannot chip out more wood than the distance to the depth gauge. The holders themselves can also include a raker. Alternatively, other links of the chain can include a raker upstream of a cutter such as on the drive link. The cutting links 18, tie-straps 22, drive links 36, safety links 40, and other links of the chain each include a pair of rivet holes 14 for receiving rivets 16, which pivotally fasten the saw chain links together in a well-known manner.

Those skilled in the art will appreciate, in view of this disclosure, that a complete saw chain can include other conventional links or connected components that are part of the saw chain. For example, in chain saws the drive links have a conventional design which engages the chain saw drive sprocket and a sprocket at the end of a guide bar.

The saw chain disclosed herein can be employed with associated links enabling use in any standard chain design. For example, associated links can be used in full complement, semi-skip (half-skip), and full skip chains, which designations refer to the number of tie-straps between cutters. In the 2003 website by Manufacturer's Supply Inc., which is incorporated herein by reference in its entirety, a full compliment chain is described as chain having a first cutter, a tie strap and another cutter (e.g., a right cutter, a tie-strap, a left cutter, a tie strap, a right cutter, etc.); a semi-skip chain is described as having alternating one and two tie-straps after cutters (e.g., a right cutter, a tie-strap, a left cutter, two consecutive tie-straps, a right cutter, etc); full skip chain is described as having two tie-straps after cutters (e.g., a right cutter, two consecutive tie-straps, a left cutter, two consecutive tie straps, a right cutter, etc.). The saw chain is suitable for use in all chain pitches (i.e., the distance between three consecutive rivets divided by two) including ¼, 0.325, ⅜, ⅜ extended, 0.404, ½ and 0.750 inch pitches. The saw chain is also suitable for all gauges (i.e., the thickness of the drive link, determined by measuring the portion of the drive link that fits into the groove of the guide bar), including 0.043", 0.050", 0.058", 0.063", and 0.080." Exemplary wood-cutting chains include, but are not limited to, chains for timber harvesters, chain saws, buck saws and saws for cutting wood pallets.

Rivets function to hold saw chain component links together. The amount of rivet head material, its proper shape, and proper shape of the rivet holes in each link are important to saw chain strength. Referring again to FIG. 1, a top view of a portion of the saw chain is shown with exemplary rivets 34. The uppermost rivet 34 is shown as including smaller diameter flanges 48 extending from both sides of a larger "bearing surface," or barrel 50. The elongated barrel design of the rivet and the thicker tie straps and cutter holder links will reduce chain-shot resulting from rivet shear and tie strap or cutter holder link breakage. The lowermost rivet 34 is shown with formed rivet heads 52. Rivet heads 52 are formed, for example, by peening or hammering the flanges 48, thereby securely connecting the associated links together. After hammering, a specialty tool called a "spinner" can be used to properly form the rivet head 52 for maximum strength. Radiused or chamfered corners 54 can be formed in the transition area 56 between the barrel portion 50 to the small diameter flange portion 48. The transition area 56 is formed, for example, by machining. Existing designs do not utilize a transition area or chamfers, but are instead made with sharp corners that create stress risers. The addition of chamfered corners 54 in the transition area of the rivet 56 add strength to the rivet 34 and eliminate the occurrence of cracking or stress risers, especially during heat treatment processes.

Figure 2:
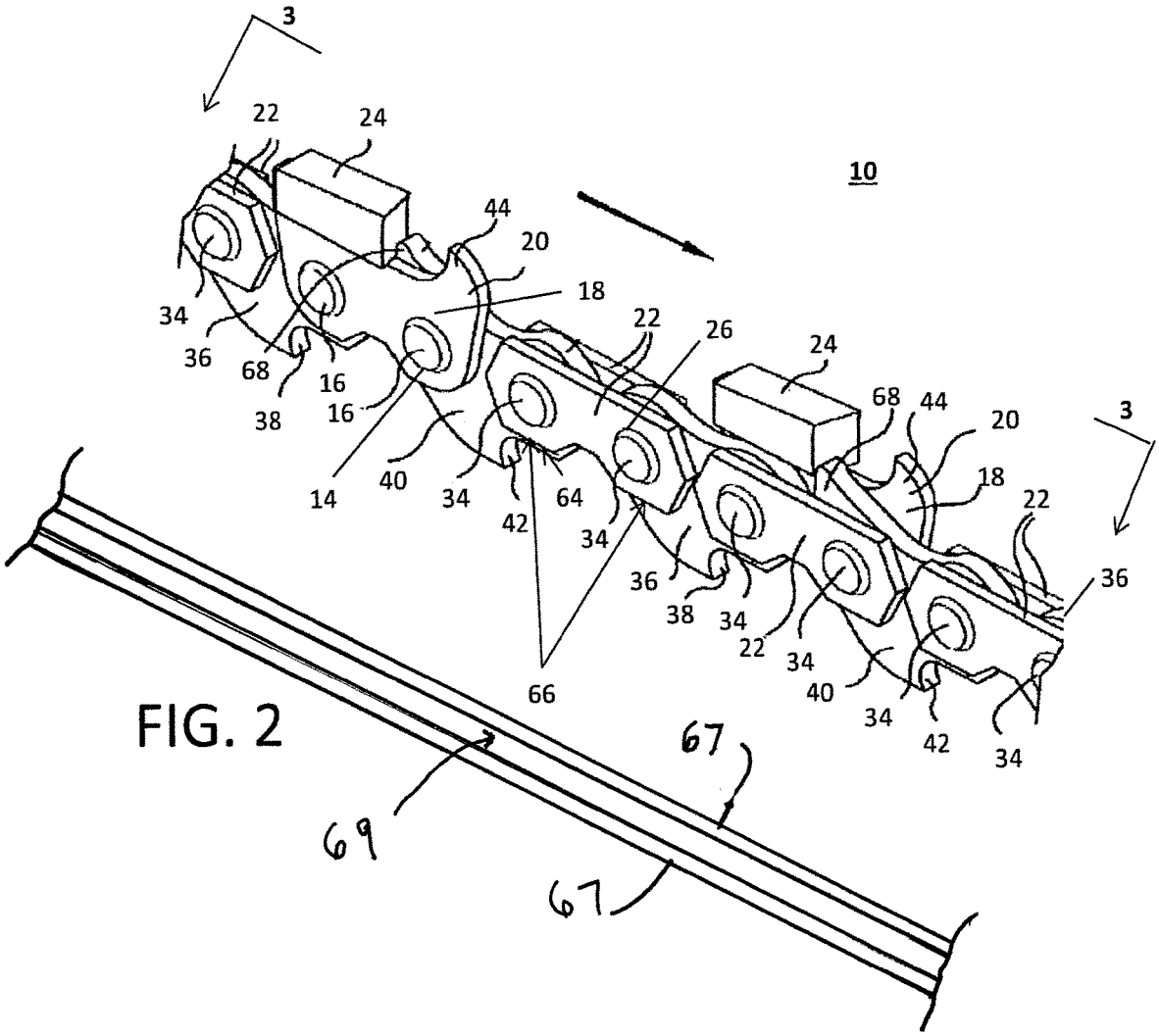
FIG. 2 is a perspective view of a saw chain constructed in accordance with the present disclosure.

Exemplary rivets 34 are shown in FIG. 1 as being disposed in aligned rivet holes 26 of a left-hand tie strap 22*a*, and connecting a drive link 36 to a right-hand tie strap 22*b* such that the drive link is sandwiched between the tie straps 22. However, exemplary rivets 34 can replace any of the standard rivets 16, as illustrated in FIG. 2, to connect the links 12 the saw chain 10. As will be appreciated by one skilled in the art reading this disclosure, when used in place of a standard rivet 16 to connect any of the links 12, exemplary rivet 34 can be coupled with an exemplary tie strap 22, or connected to another link through a hole having the advantageous features of tie strap rivet hole 26, as described below. The exemplary tie straps 22 each include a pair of holes 26 for receiving rivet 34. Standard holes 14 for receiving rivets are shaped in various ways as would be appreciated by those skilled in the art, such as circular holes. Exemplary rivet holes 26 are also circular, however they advantageously include a radiused or chamfered outside edge 30. Known tie straps have circular rivet holes with sharp edges that interfere with the sharp corners of rivets, creating a shear point at the smallest diameter of the rivet. Chamfered edge 30 provides a clearance fit for the chamfered rivet corner 54 described above. Unless edge 30 is chamfered, a sharp edge would remain on the hole 14 which would interfere with the chamfered rivet corner 54 described above, and the shear point otherwise created by this interference would remain. In addition, the chamfered edges 30 add strength to the tie straps 22 and eliminate the occurrence of cracking or stress risers, especially during heat treatment processes.

The chamfer 30 on the outside diameter of the hole 26 is preferably formed by removing the material creating the sharp edge through machining. Machining is advantageous to other techniques for modifying raw material (e.g., steel), such as progressive stamping. Stamping merely compacts or moves the material, which can cause an uneven surface. Machining allows for more controlled material removal to achieve a more even surface on the inside of the tie strap.

In addition, exemplary rivet 34 is provided with a barrel 50 having a length L and flanges 48 extending outward from either side of the barrel. The diameter D of the barrel 50 is larger than the diameters d of the flanges 48. The exemplary rivet hole 26 includes an interior counterbore 28 formed on the inside of the hole. Interior counterbore 28 receives the barrel 50 of the rivet 34. During operation of the saw chain, the combination of the chamfered corners 54 on the rivet 34, the chamfered edges 30 on the rivet hole 26, the interior counterbore 28, and the barrel 50 ensure that the shear forces are acting against the inside of the tie strap 22 on the largest diameter of the rivet. This combination of features advantageously increases the strength of the saw chain by changing the shear point to a more advantageous, safer location, reducing the risk of rivet shear.

Additional features of an exemplary tie strap 22 for use in the saw chain further increase strength and safety. For example, an exterior counterbore 32 is formed on the outside of the tie strap 22. The exterior counterbore 32 aids in keeping the overall saw chain chassis as narrow as possible, depending on the desired characteristics of the saw chain. The rivet head 52 is formed, for example, by peening or hammering the flanges 48 of the rivet 34 into the counterbore 32, so that a top surface 60 of the rivet head is flush with an exterior surface 62 of the tie strap 22. The counterbore 32 protects the rivet head 52 from friction forces acting between the head and cutting material during a cutting operation. In addition, the counterbore 32 protects the rivet head 52 from wear after repeated use of the chain. Therefore, the counterbore 32 increases the overall strength of the saw chain 10.

With reference to FIG. 2, the bottom 64 of the tie strap 22 rides on a bearing surface 66 between the bottom of the tie strap and the rails of the saw chain bar. Existing tie straps generally have a width or thickness approximately equal to the gauge of the drive link. Common drive link gauges include 0.043", 0.050", 0.058", 0.063", and 0.080" which match the width of the groove between the rails of the guide bar so that the drive link can tightly fit into the groove. Tie straps necessarily connect to the outside of the drive links, such that the bottom of the tie straps contacts a top edge of the guide bar rails 67 with link portions being received in passage 69 during operation of the saw chain. This contact area between the tie straps and rails creates a bearing surface in existing systems that only partially covers the top edge of the guide bar rails. The tie straps 22 disclosed herein have a thickness corresponding to a contact area or bearing surface 66 which is approximately doubled compared to existing designs. This doubling of the bearing surface 66 corresponds to tie straps having a thickness approximately double the gauge of the drive link 36. For example, the approximate thickness of tie strap 22 can be as great as 0.16". In any event, the tie strap thickness can be chosen so that the bottom of the tie strap has a bearing surface which completely covers the top edge of the guide bar rails. Unless covered, the top edge contacts the cutting material during a cutting operation, which pushes apart or splays the rails of the guide bar. By covering the top edge of the guide bar rails, tie straps 22 will greatly reduce bar wear and wear on the underside of the chain links. The added thickness of the tie strap and cutter holder link will also reduce wear on the inside edges of the bar rails by making the chain more stable and less prone to rocking in the bar groove.

In addition to reduced guide bar wear, the wear of the saw chain 10 itself is greatly reduced. Doubling the contact area of bearing surface 66 increases chain stability as the chain as rides on the bar rails and keeps the chain upright in the groove. Otherwise, the chain can move laterally with respect to its upright position. If the saw chain 10 moves laterally when traveling in cutting direction T, the resultant forces on the links 12 of the saw chain 10 can be greater on portions of the component links not intended to receive such forces. This causes increased wear on the saw chain 10 and the risk of chain shot. Lateral movement of the saw chain also causes increased wear on the groove portion of the guide bar. By comparison, the doubled contact area of bearing surface 66 aids in ensuring the saw chain 10 remains upright, thereby reducing the risk of the aforementioned problems.

In an exemplary embodiment, the tie strap 22 described above can be used in combination with an exemplary cutting link 18. Instead of the time-consuming chain sharpening by hand by workers or outright replacement with a sharp chain, a quick change chain is provided which enables individually worn or damaged teeth 24 to be easily removed by tapping them off the chain or by using a specialized tool. In addition, the holding links 20 can be used to replace damaged holding links of a saw chain. When the entire chain is worn, the worker simply obtains a set of sharp teeth, removes all of the worn teeth, and slides the sharp teeth on the chain. No separate fasteners such as screws need to be used to enable removal or installation of the teeth.

Cutting links with replaceable teeth provide further advantages in view of this disclosure to one skilled in the art. The plurality of teeth 24 being replaceable, sharpening is no longer required. Teeth which require sharpening over the life of the cutting link reduce in size as material is removed from the sharpening process. This causes a reduction in the chain's width or kerf K (FIG. 1). In other words, the relief space between the sides of the chain and the material being cut becomes less and less as the chain is necessarily sharpened over time. The overall chain width becomes closer to the thickness of the tie strap as the relief space decreases, increasing the likelihood of the tie strap getting caught in the cutting material during operation. This leads to the problem of the guide bar becoming "stuck" in the cutting material, a condition which can occur earlier in the saw chain life if the thickness of the tie strap is increased. Accordingly, the thickness of tie straps is limited by saw chain designs which require repeated sharpening of the teeth. However, the saw chain disclosed herein uses replaceable teeth to maintain the same kerf over the life of the chain. As such, the relief space between the sides of the chain and the material being cut never decreases, and the thickness of the tie strap is not limited by the need to sharpen teeth. Accordingly, the tie straps 22 as disclosed herein have an increased thickness so that the aforementioned advantageous features can be incorporated without the increased risk of a stuck guide bar.

Figure 3:
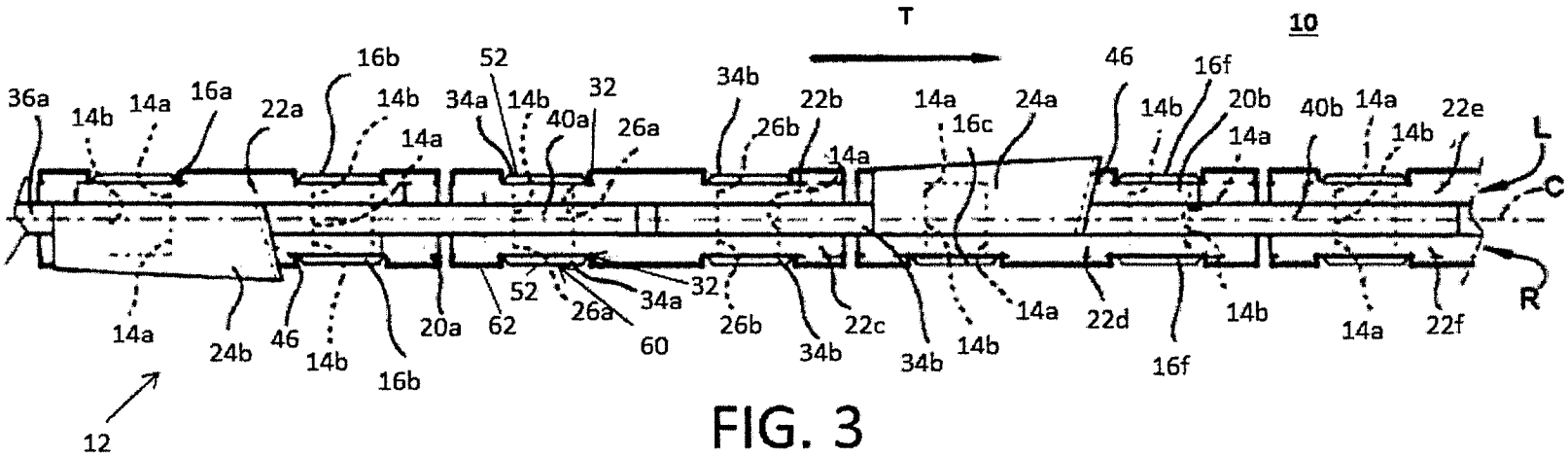
FIG. 3 is a top plan view of the saw chain as seen along the lines and arrow designated 3-3 in FIG. 2.

FIG. 3 illustrates an assembled saw chain constructed with the advantageous features and components disclosed herein. A left side tie strap 22*a* has a downstream hole 14*a* aligned with an upstream hole 14*b* of a drive link 36*a* and with a downstream hole 14*a* of a right side holding link 20*a*. The rivet 16*a* has one flange of the rivet extending through the downstream hole 14*a* of the left side tie strap 22*a*, the barrel is received in the upstream hole 14*b* of the drive link 36*a*, and the other flange extends through a downstream hole 14*a* of a right side holding link 20*a*. The drive link 36*a* is sandwiched between the left side tie strap 22*a* and the right side holding link 20*a*. The links are secured when the rivet flanges are peened or hammered to form rivet heads on both sides of the saw chain. The sequence of components of the chain repeats in this or a similar fashion depending on the chain design (e.g., full complement, semi-skip (half skip) and full skip chains), with left side links comprising either a tie strap 22 or a holding link 20, right side links comprising either a tie strap or holding link, and the links sandwiched between the left side and right side link comprising either a drive link 36 or a safety link 40. Respective upstream and downstream holes allow each component feature to be secured by rivets, until a full chain is linked.

For clarity, the link and rivet connections described above in reference to FIG. 3, used reference number 14 to identify all of the holes of the links 12 of the saw chain, and used reference number 16 to identify all of the rivets which connect the links through the holes. However, the exemplary rivets 34, tie straps 22, and tie strap rivet holes 26, as illustrated in FIG. 1, can be used in place of any of the rivets 16, other referenced links, and holes 14, respectively, which are referenced in FIGS. 2-5. As will be appreciated by one skilled in the art reading this disclosure, when used in place of a standard rivet 16 to connect any of the component links 12, exemplary rivet 34 is connected to an exemplary tie strap 22, or to another link through a hole having the advantageous features of tie strap rivet hole 26. Doing so allows the saw chain 10 to be assembled as illustrated in FIG. 3, with the advantageous tie straps 22 and rivets 34 engaging one another to reduce the risk of chain shot.

For example, second assembled link in FIG. 3 is referenced with the exemplary rivets 34, tie straps 22, and tie strap rivet holes 26, as illustrated in FIG. 1, as follows. The left side tie strap 22*b* has a downstream hole 26*a* aligned with an upstream hole 14*b* of a safety link 40*a* and with a downstream hole 26*a* of a right side tie strap 22*a*. The rivet 34*a* has one flange of the rivet extending through the downstream hole 26*a* of the left side tie strap 22*b*, the barrel extends through the upstream hole 14*b* of the safety link 40*a* and is received by the interior counterbore 28 of the tie strap 22*b*, and the other flange extends through a downstream hole 26*a* of a right side tie strap 22*c*. The safety link 40*a* is sandwiched between the left side tie strap 22*b* and the right side tie strap 22*c*. The links are secured when the rivet flanges are peened or hammered to form rivet heads 52 on both sides of the saw chain. The exterior counterbores 32 of the tie straps 22 allow for a top surface 60 of the rivet head 52 to sit flush with an exterior surface 62 of the tie strap 22. The links are secured when the rivet flanges are peened or hammered to form flush rivet heads 52 on both side of the saw chain. The upstream hole 26*b* of the left side tie strap 22*b* is aligned with a downstream hole 14*a* of a drive link 36*b* and with an upstream hole 26*b* of right side tie strap 22*c*. Rivet 34*b* secures the links together in a similar fashion as previously described, such that drive link 36*b* is sandwiched between the left side tie strap 22*b* and the right side tie strap 22*c*. The sequence of components of the chain repeats in this or a similar fashion until a full chain is linked.

The saw chain disclosed herein can include various modifications that would be apparent to those of ordinary skill in the art in view of this disclosure. In this disclosure like components are given like reference numbers throughout the several views. With reference to FIG. 1, a straight-sided counterbore 28 on the inside hole 26 of the tie strap 22 is shown. With a straight-sided counterbore, a slip fit or even a light press fit can be used. Alternatively, a taper can be formed on the counterbore 28 to engage a tapered seat portion, or wedge of the rivet barrel 50 (not shown). The tapered fit could be achieved with a slip fit or light press fit, as with the straight-sided counterbore 28, which would ensure that no space exists between the rivet barrel and the inside of the counterbore on the tie strap.

One manner such close tolerances can be achieved is by forming the tapered surfaces on the base material (e.g., composed of steel) through machining or by progressive stamping. Although the present disclosure is not limited to the use of machining or progressive stamping and the manufacturing techniques for such processes in achieving such close tolerance. Other techniques for achieving the close tolerance without machining are included within the scope of the present disclosure. The tapered surfaces can be formed so as to comprise sintered and compacted particles of material (known as "sintered metal," "powdered metal" or "sintered ceramic") as disclosed in the U.S. patent application Ser. No. 10/780,323, which is incorporated herein by reference in its entirety. Use of sintered and compacted particulate metal or ceramic is a cost-effective technique known by the inventors to achieve the close tolerance.

An advantage of designing a tapered surface as disclosed in the Ser. No. 10/780,323 application on the interior counterbore 28 and the rivet barrel 50 of sintered and compacted particulate material is that the material can advantageously be formed in near final net shape and used as processed with little machining except for grinding of the tapered surface. This enables the uniquely close tolerance of the tapers to produce a self-locking engagement of the tie strap and rivet. In use, the self-locking tapers of the counterbore and rivet barrel provide effective and strong self-locking connection between the tooth and holder. The sintered and compacted material has much better hardness and durability compared to steel, which can dramatically extend chain life.

The aforementioned optional safety links will be described in further detail with reference to FIGS. 4-5. A function of the saw chain according to the present disclosure is to enable material to be cut or abraded using teeth that are quickly replaceable, while maintaining a strong and safe saw chain. In this regard, a plurality of exemplary safety links 40 are provided. Each of the safety links 40 comprise a safety lobe 68 extending in proximity to the tooth. During operation of the saw, at which time the chain rotates around the bar, dislodging of the teeth 24 from the holders 20 in the chain travel direction T is prevented by the safety lobes 68. With specific reference to FIG. 4, the safety link 40*a* includes an imaginary reference line B that intersects the centerpoints of the upstream and downstream rivet holes 14*b*, 14*a* of the safety link. The body of the safety link 40*a* has a height h1 along the arrow at a location perpendicular to the reference line B and intersecting a centerpoint of the upstream hole 14*b* of the safety link. The safety lobe 68 of the safety link 40*a* extends to a height h2 along the arrow perpendicular to the reference line B and intersecting the centerpoint of the downstream hole 14*a* of the safety link. The safety lobe 68 is located in a region in the chain travel direction T between the line h2 and a line h3 extending perpendicular to the reference line B at a most trailing end surface of the safety link 40*a* downstream of the downstream hole 14*a*. The height h2 is greater than the height h1. The central portion of the body of the safety link 40*a* has a height h4 perpendicular to the reference line B at the midpoint between lines h1 and h2. With respect to lines h2, h1, and h4, h2<h1<h4. In other words, the safety lobe 68 extends to a maximum height of the safety link (height h2) that is higher than the front portion of the safety link (height h1), which extends higher than the central portion of the safety link (height h4) that is approximately at a minimum height of the safety link.

Once it is determined by the user that one or more teeth should be replaced, such as due to damage or wear of the teeth, the saw is operated (e.g., shut off) to stop movement of the chain. The chain is removed from the saw. Referring to FIG. 5, the safety link 40*b* is pivoted out of a path of an adjacent tooth 24*b* needing replacement. Safety link 40*b* is pivoted downward out of the path of the tooth 24*b* (in the clockwise direction of arrow 70). This enables the tooth 24*b* to be removed from the holder 20*b* in the direction shown by arrow 72 and replaced with a new or replacement tooth 24 in the direction opposite to arrow 72. The chain is pivoted back to an operational position. That is, the safety link 40*b* is pivoted in the counterclockwise direction. The chain is then re-installed onto the bar of the saw. This operation eliminates the need to sharpen teeth. Accordingly, the saw chain can maintain a constant kerf over its lifetime, allowing the use of tie straps with increased thickness as illustrated FIG. 1. That is, the tie straps 22, holes 26, and rivets 34, as illustrated in FIG. 1, can be utilized with the saw chain 10 depicted in FIGS. 4-5 to connect the exemplary safety links 40 to the other links 12 in the saw chain.

Figure 4:
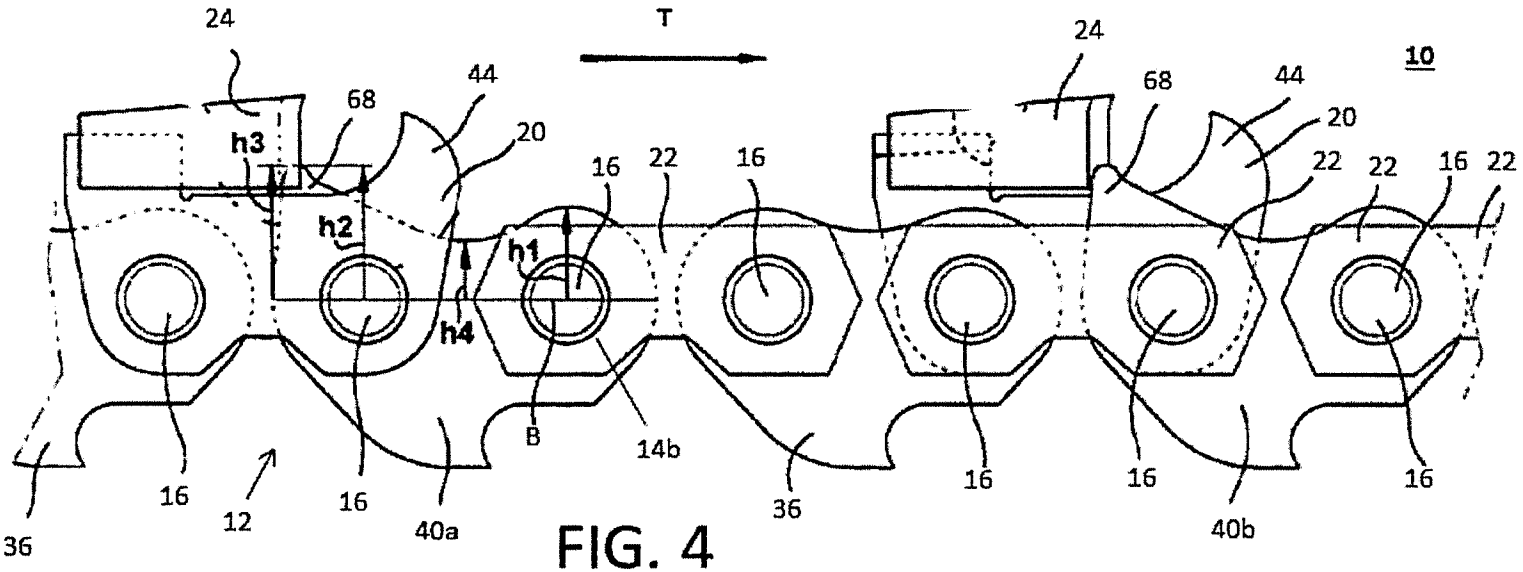
FIG. 4 is a side elevational view of the saw chain of FIGS. 1-3.
Figure 5:
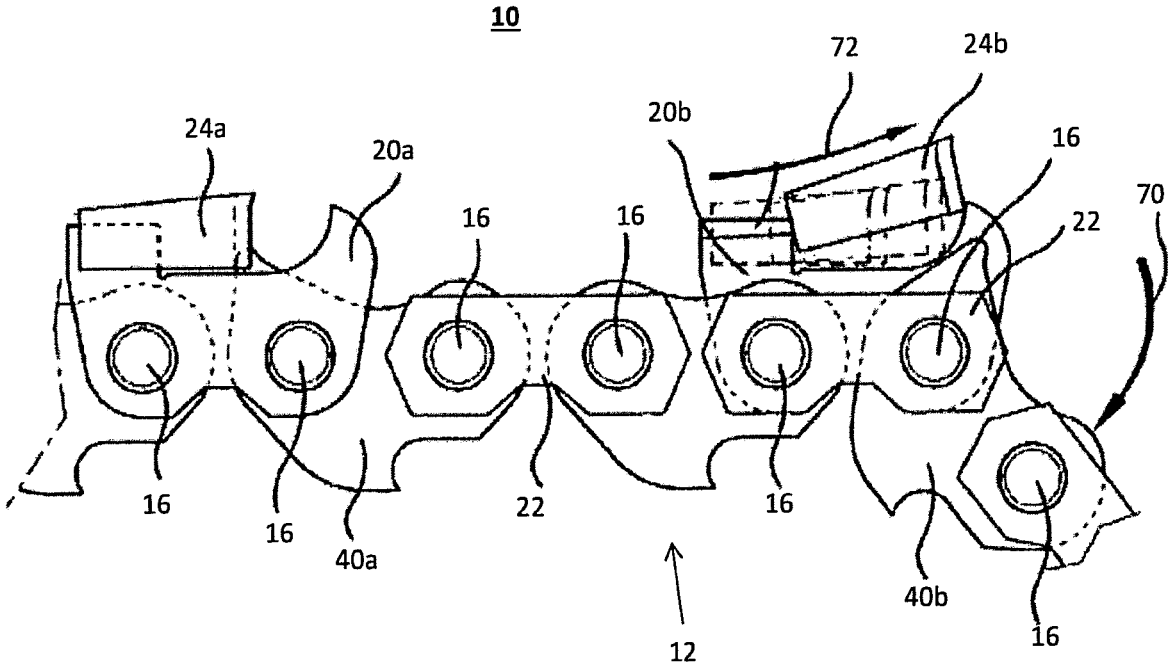
FIG. 5 is a side elevational view of the saw chain of FIG. 4 showing how a safety lobe of a safety link is rotated out of the path of a tooth for removal and replacement of the tooth.

Additional details of the specific features of the safety links shown in FIGS. 4-5 are described in U.S. Pat. No. 7,836,808 to Szymanski, herein incorporated by reference in its entirety.

Figure 6:
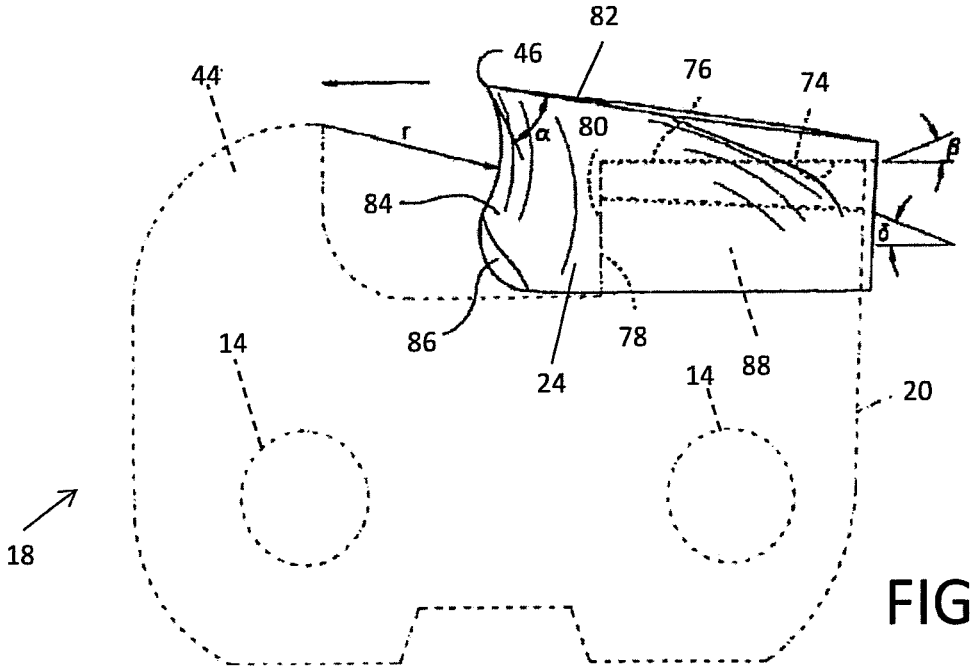
FIG. 6 is a side view of the tooth of FIGS. 1-5 showing a self-locking taper-and-wedge design in accordance with the present disclosure.
Figure 7:
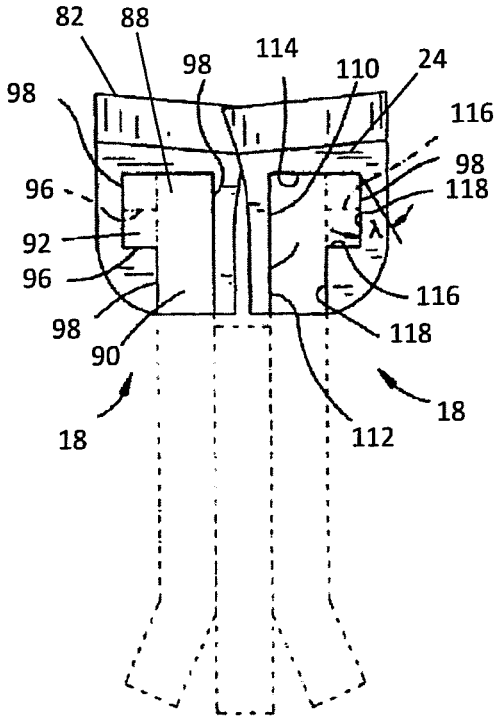
FIG. 7 is a rear view of left and right sided teeth of the chain shown in FIGS. 1-6.
Figure 8:
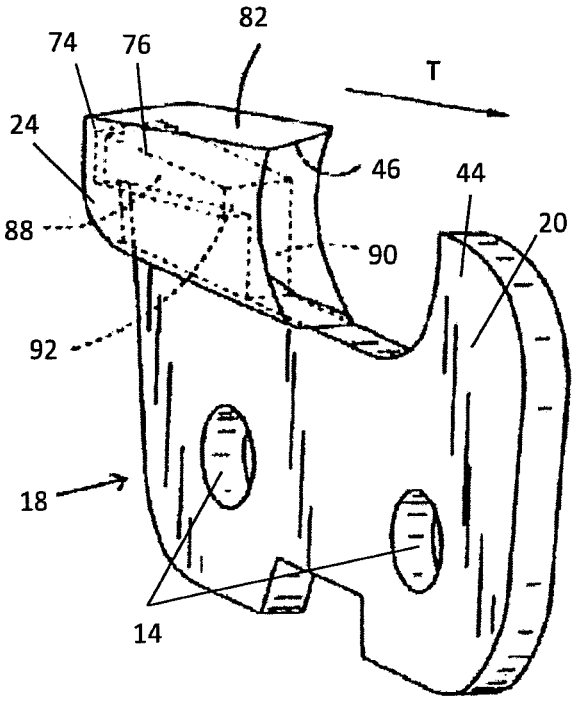
FIG. 8 is a perspective front view of the right sided tooth shown in FIG. 6 showing the self-locking taper-and-wedge design in accordance with the present disclosure.

FIGS. 6-8 further illustrate the features of the aforementioned replaceable teeth. With reference to FIGS. 6 and 8, an exemplary cutting link 18 comprises a holder 20 and replaceable tooth 24, wherein sharpening which would otherwise reduce chain kerf, is unnecessary. The tooth 24 has an internal tapered surface 74 which engages a tapered seat surface 76 of the holder. The tapered surfaces can be formed as disclosed in the U.S. patent application Ser. No. 10/780,323, which is incorporated herein by reference in its entirety. The seat surface 76 is also referred to as a wedge. The tapered surfaces 74 and 76 extend in the general direction of chain travel T and engage each other such that the taper and wedge are self-locking. The tooth has an abutment surface 78 that extends generally vertically in the view of FIG. 6 and abuts against a stop surface 80 which extends generally vertically in the view shown in FIG. 6, transverse to the chain travel direction, and leads to the seat surface 76 of the holder. Each tooth comprises a cutting edge 46 that penetrates the wood fibers. Another part of the tooth is the top surface 82 which affects the width or kerf of the saw chain. The tooth has a chisel angle $\alpha$ as shown in FIG. 6 that finishes making the cut and pushes chips from the saw kerf, which is about 80° or other suitable conventional angle. A leading or front surface 84 of the tooth forms the cutting edge at an upper surface thereof. An optional beveled surface 86 (FIG. 6) provides relief enabling good flow of wood chips. The use of replaceable teeth eliminates the need for sharpening. Accordingly, the saw chain can maintain a constant kerf over its lifetime, allowing the use of tie straps with increased thickness as illustrated FIG. 1. That is, the tie straps 22, holes 26, and rivets 34, as illustrated in FIG. 1, can be utilized with the saw chain depicted in FIGS. 6-8 to connect the exemplary cutting links 18 to the other links 12 in the saw chain 10.

The specific features of the removable teeth shown in FIGS. 6-8 are described in U.S. Patent Pub. No. US 2005/0178263 A1 to Szymanski, herein incorporated by reference in its entirety. Of course, the present chain is not limited to replaceable teeth configurations. Furthermore, the chain does not have to be completely removed from the bar in order to change dull or broken teeth. It merely needs to be loosened to rotate the keeper link forward to allow the tooth to be removed from its internal wedge.

It should be understood that the present disclosure includes any tooth design having various external shapes, whether they are curved in the region of the cutting edge as shown or straight, whether they have variations in side surfaces and geometries of locking surfaces such as fastening surfaces different from the inverted L-shaped recess and projection shown, so long as the teeth include the self-locking taper-and-wedge and/or are formed of sintered and compacted particles of material.

It should also be understood that the component links described thus far can be combined into any standard chain design, including full complement, semi-skip (half-skip), and full skip chain designs. The arrangement of the component links in each design is defined above. The aforementioned cutting links 18, which comprise a holding link 20 and a replaceable tooth 24, allow an end user the freedom to choose any arrangement of component links covered by these chain designs. This is possible because the customer can add or remove holding links 20 and teeth 24 in an arrangement corresponding to his or her desired chain design, depending on the end user's cutting needs. In comparison, existing saw chains require the customer to purchase multiple chains if the cutting characteristics of each saw chain design are desired. Of course, the present chain design is not limited to wood applications. In fact, the outer counter bore may be particularly advantageous with abrasive materials such as concrete, stone, paper, etc. because friction and rivet head wear is reduced.

It should further be understood that the present disclosure is not limited by descriptive terms such as left, right, front, back, top, vertical and the like, as these terms are provided to improve understanding and apply to the views shown in the drawings. These relative terms can differ upon change in the orientation and position of the chain and teeth.

Exemplary metal compounds which are suitable for use in the various components as referenced herein as the sintered and compacted particulate material are typically accepted tool steels including, but not limited to, A2, D2 and M2 AISI designations of air hardening tool steels which can be supplied, for example, by Carpenter Steels or Pacific Sintered Metals and are known to possess excellent impact resistance. The following are the chemical compositions of the exemplary A2, D2 and M2 AISI designations of air hardening tool steels alloys suitable for use as sintered and compacted metal materials for forming the various links in the saw chain.

A2 consists essentially of 1.0% carbon, 0.8% manganese, 0.3% silicon, 5.25% chromium, 1.10% molybdenum, 0.2% vanadium with the balance being iron and unavoidable impurities. D2 consists essentially of 1.5% carbon, 0.5% manganese, 0.3% silicon, 12% chromium, 0.8% molybdenum, 0.9% vanadium with the balance being iron and unavoidable impurities.

M2 consists essentially of 0.82% carbon, 0.3% manganese, 0.25% silicon, 4.25% chromium, 5% molybdenum, 6.25% tungsten, 1.8% vanadium with the balance being iron and unavoidable impurities. Information and fabrication services from Pacific Sintered Metals regarding an M2 alloy and other "fully dense" or "near fully dense" powdered metals (i.e., a density close to theoretical density as known in the powdered metal or powdered ceramics industry), which are suitable for fabricating the teeth and/or holders of the present disclosure as apparent to one skilled in the art in view of this disclosure, is available from that company or provided on its website (www.pacificsintered.com) dated Jan. 7, 2004, which is incorporated herein by reference in its entirety.

L6 consists essentially of 0.7% carbon, 0.35% manganese, 0.25% silicon, 1.00% chromium, 1.75% nickel with the balance being iron and unavoidable impurities.

The elongated barrel design of the rivet allows for a higher hardness for the rivet because it eliminates the shear point that exists in current chain designs. A harder rivet is more prone to brittleness, but the larger diameter of the barrel adds strength. A harder rivet head will wear longer than the rivets currently used commercially. For example, a material having a hardness of at least about 35 Rockwell C, or preferably 45 Rockwell C, or more preferably 42 Rockwell C may be desirable.

upon reading and understanding the preceding detailed description. It is intended that the exemplary embodiment be construed as including all such modifications and alterations insofar as they come within the scope of the appended claims or the equivalents thereof.

The invention claimed is:

1. A saw chain comprised of at least one chain link selected from a cutting link and a drive link, at least one tie strap pair, said chain link and said tie strap pair defining a hole passing therethrough, a rivet disposed within said hole and joining said chain link and said tie strap pair, each tie strap of said tie strap pair having a wall defining said hole, said rivet comprising a central barrel region and two opposed flanges, said barrel region being received within a center bore of said hole, each of said flanges passing through a reduced diameter region of said hole formed by projections form the wall of each said tie strap pair such that internal edges of said projections cooperatively retain said barrel region, said projections including a chamfered edge facing said barrel region, each of said tie strap pair further including a counter bore inward of said projection, an outer circumferential surface of said barrel region engaging the wall of the tie strap at said counter bore, each flange terminating in a head region, each head region engaging an external surface of said projections.

2. The saw chain of claim 1, wherein the hole includes counter bore regions outward from said projections.

3. The saw chain of claim 2, wherein each head region of the rivet is received within said counter bore regions such that a width of said saw chain at said rivet is less than or equal to a width of said saw chain at all locations remote from said rivet.

4. The saw chain of claim 2, wherein said outward counter bore has a greater diameter than said inward counter bore.

5. The saw chain of claim 1, wherein said rivet includes a radiused corner between said barrel region and each of said flanges.

6. The saw chain of claim 1, wherein said rivet is comprised of a material having a hardness greater than about 40 Rockwell C.

7. The saw chain of claim 1, wherein each tie strap has a width equal to or greater than a width of the associated chain link.

8. The saw chain of claim 1, wherein each tie strap has a width equal to or greater than an associated guide bar rail.

9. The saw chain of claim 1, wherein said barrel region has a diameter greater than a diameter of each flange.

10. The saw chain of claim 9, wherein said head regions have a diameter greater than the diameter of each flange and less than a diameter of said barrel region.

11. The saw chain of claim 1, wherein said barrel region has a length greater than a length of one flange excluding the head region.

12. The saw chain of claim 1, wherein said barrel region has a length greater than a length of one flange and the associated head region.

13. The saw chain of claim 1, wherein said barrel region has a length greater than a width of said chain link.

* * * * *